US007209568B2

(12) United States Patent
Arndt et al.

(10) Patent No.: US 7,209,568 B2
(45) Date of Patent: Apr. 24, 2007

(54) HEARING AID HAVING AN ADJUSTABLE DIRECTIONAL CHARACTERISTIC, AND METHOD FOR ADJUSTMENT THEREOF

(75) Inventors: Georg-Erwin Arndt, Obermichelbach (DE); Harald Klemenz, Fürth (DE); Hartmut Ritter, Neunkirchen am Brand (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 460 days.

(21) Appl. No.: 10/893,649

(22) Filed: Jul. 16, 2004

(65) Prior Publication Data

US 2005/0041824 A1 Feb. 24, 2005

(30) Foreign Application Priority Data

Jul. 16, 2003 (DE) ..... 103 31 956

(51) Int. Cl.
*H04R 25/00* (2006.01)

(52) U.S. Cl. ..... 381/313; 381/312; 381/318

(58) Field of Classification Search ..... 381/312–313, 381/316–318, 320, 92
See application file for complete search history.

(56) References Cited

U.S. PATENT DOCUMENTS 5,524,056 A 6/1996 Killion et al.
6,327,370 B1 12/2001 Killion et al.
6,424,721 B1 7/2002 Hohn
7,027,607 B2 * 4/2006 Pedersen et al. ..... 381/313

FOREIGN PATENT DOCUMENTS

| | | |
|---|---|---|
| DE | 101 14 101 | 6/2002 |
| EP | 1 005 783 | 2/2002 |
| WO | WO 99/04598 | 1/1999 |
| WO | WO 00/76268 | 12/2000 |
| WO | WO 01/01731 | 1/2001 |
| WO | WO 01/01732 | 1/2001 |
| WO | WO 01/10169 | 2/2001 |
| WO | WO 01/60112 | 8/2001 |

* cited by examiner

*Primary Examiner*—Suhan Ni
(74) *Attorney, Agent, or Firm*—Schiff Hardin LLP

(57) ABSTRACT

In a hearing aid, as well as in a method for the operation of a hearing aid having a microphone system in which different directional characteristics can be set, the tonal quality is improved, particularly in a quiet hearing environment, by the signal delay for at least one microphone signal being increased so as to increase the transfer function in the frequency response of the microphone system, thus also improving the signal-to-noise ratio, by decreasing the proportion of the microphone noise in the microphone output signal.

18 Claims, 2 Drawing Sheets

HEARING AID HAVING AN ADJUSTABLE DIRECTIONAL CHARACTERISTIC, AND METHOD FOR ADJUSTMENT THEREOF

BACKGROUND OF THE INVENTION

1. Field of the Invention

The present invention relates to hearing aids as well as methods for the operation of hearing aids of the type having a microphone system for picking up an acoustic input signal and for emission of a microphone output signal, a signal processing unit, and an output transducer for emission of an output signal.

2. Description of the Prior Art

Modern hearing aids use devices for classification of hearing situations. The transmission parameters of the hearing aid are automatically varied depending on the hearing situation. In this case, the classification may, inter alia, influence the method of operation of the interference noise suppression algorithms, and of the microphone system. Thus, for example, depending on the identified hearing situation, a choice is made (by discrete switching or by continuous overlaying) between an omnidirectional characteristic (zero directional characteristic) and significant directionality of the microphone system (first or higher order directional characteristic). The directional characteristic is produced by using gradient microphones or by electrically connecting a number of omnidirectional microphones to one another. Microphone systems such as these have a frequency-dependent transmission response, which is characterized by a considerable fall at low frequencies. The noise behavior of the microphones, on the other hand, is not dependent on the frequency, and is slightly amplified in comparison to an omnidirectional microphone. In order to achieve a natural tonal impression, the high-pass frequency response of the microphone system must be compensated for by amplification of the low frequencies. In the process, the noise that is present in the low frequency range is likewise amplified and, in some circumstances, is significantly audible in a disturbing manner, while quiet sounds are masked by the noise.

German OS 101 14 101 discloses a method for processing an input signal in a signal-processing unit in a hearing aid. One embodiment of the known hearing aid has two microphones, with a delay element being connected to one microphone, the delay of which is set as a function of the result of a modulation analysis, in order to improve the signal processing and to reduce the interference noise.

PCT Application 00/76268 discloses a hearing aid having a signal processing unit and at least two microphones, which can be connected to one another in order to form directional microphone systems of different order, in which case the directional microphone systems may themselves be connected to one another with a weighting which is dependent on the frequency of the microphone signals emitted from the microphones. The cut-off frequency between adjacent frequency bands in which a different weighting is provided for the microphone signals can be set as a function of the result of a signal analysis.

European Application 0 942 627 discloses a hearing aid having a directional microphone system with a signal processing device, an earpiece and a number of microphones, whose output signals can be connected to one another via delay devices and the signal processing device, with different weightings, in order to produce an individual directional microphone characteristic. The preferred reception direction (main direction) for the directional microphone system can be set individually to match an existing hearing situation.

U.S. Pat. No. 5,524,056 discloses a hearing aid having an omnidirectional microphone and having a first or higher order directional microphone. The low signal frequency range in the microphone signal from the directional microphone is amplified, and is matched to the microphone signal from the omnidirectional microphone. Both the microphone signal from the omnidirectional microphone and the microphone signal from the directional microphone are supplied to a switching unit. When the switching unit is in a first switch position, the omnidirectional microphone is connected to a hearing aid amplifier, and when the switching unit is in a second switch position, the directional microphone is connected to a hearing aid amplifier. The switching unit can switch automatically as a function of the signal level of a microphone signal.

The known hearing aids with a directional microphone system have the disadvantage that, in certain hearing situations, either the directionality of the microphone system is not optimally used, or a high degree of directionality leads to a clearly audible degradation in the tonal quality. In particular, when the level of the acoustic input signal is low, the signal-to-noise ratio becomes worse, and a hearing aid wearer perceives this in the form of disturbing microphone noise in a quiet environment.

SUMMARY OF THE INVENTION

An object of the present invention is to improve the tonal quality of a hearing aid having a directional microphone system.

This object is achieved by a hearing aid according to the invention having a microphone system with at least two microphones, in order to make it possible to produce zero and first order directional characteristics. However, more than two microphones are preferably used, so that it is also possible to produce second and higher order directional characteristics. Furthermore, the hearing aid has a signal-processing unit for processing and frequency-dependent amplification of the microphone signal that is produced by the microphone system. The signals are normally emitted in the form of an acoustic output signal by means of an earpiece. However, other output transducers are also known, for example output transducers that produce vibration.

For the purposes of the invention, a zero order directional characteristic is an omnidirectional directional characteristic that originates, for example, from a single omnidirectional microphone, which is not connected to any other microphones. A microphone unit having a first order directional characteristic (first order directional microphone) may, for example, be produced by means of a single gradient microphone, or by electrically connecting two omnidirectional microphones. First order directional microphones can be used to achieve a theoretically achievable maximum directivity index (DI) value of 6 dB (hyperkidney). In practice, DI values of 4–4.5 dB are obtained on the KEMAR (a standard research dummy) with the microphones positioned optimally and with the best matching of the signals that are produced by the microphones. Second and higher order directional microphones have DI values of 10 dB or more, and are advantageous, for example, for better speech comprehension. If a hearing aid contains a microphone system with, for example, three omnidirectional microphones, then, on this basis, it is possible to simultaneously produce microphone units with zero to second order directional characteristics by suitable connection of the microphones.

A single omnidirectional microphone intrinsically represents a zero order microphone unit. If, in the case of two omnidirectional microphones, the microphone signal from one microphone is delayed and is subtracted from the microphone signal from the other microphone, then this results in a first order microphone unit. If, once again in the case of two first order microphone units, the microphone signal from one microphone unit is delayed and is subtracted from the microphone signal from the second first order microphone unit, this results in a microphone unit with a second order directional characteristic. Microphone units of any desired order can be produced in this way, depending on the number of omnidirectional microphones.

If a microphone system has microphone units of different order, then it is possible to switch between different directional characteristics, for example by connecting or disconnecting one or more microphones. Furthermore, any desired mixed forms between the directional characteristics of different order can also be produced by suitable electrical connection of the microphone units. For this purpose, the microphone signals from the microphone units are weighted differently and are added, before they are further processed and amplified in the signal-processing unit in the hearing aid. It is thus possible to achieve a continuous, smooth transition between different directional characteristics, thus making it possible to avoid disturbing switching artifacts.

In the case of two omnidirectional microphones, which are connected to form a microphone unit with a first order directional characteristic, the microphone signal delay for one of the microphone signals which originate from the microphones is normally set so as to compensate for the delay time of an acoustic input signal between the sound inlet openings of the microphones. The delay normally is chosen to be less than or equal to this delay time. If the delay is less than the external delay time between the sound inlet openings of the microphones (referred to as an "endfire array"), then a directivity index which has been weighted with the articulation index (AI–DI) of up to 6.5 dB can be achieved on the KEMAR (a standardized artificial head), for example with a mixed form of first and second order. If this ratio between the internal delay and the external delay time is increased to considerably more than 1, then this AI–DI value first falls rapidly and then becomes constant at values of 4.5 to 5 dB, in a manner which is very robust with regard to component tolerances of the microphones and any further increase in the delay time. As the delay is increased, however, the signal transmission response of the relevant microphone unit changes with respect to the sound signals that arrive at the microphone unit from the main direction. In this case, the main direction in general at least approximately matches the straight-ahead viewing direction of the hearing aid wearer, when the hearing aid is being worn. The frequency response of the microphone unit with respect to such acoustic input signals can be described, approximately, by the function:

$$H=1-e^{j\omega(D_{ext}+D_{int})}$$

If the sum $D_{ext}+D_{int}$ of the external delay time and of the internal delay is doubled, this results in an increase in the microphone output signal of about 6 dB, in the range of low signal frequencies, for example for a first order directional microphone, and in an increase of about 12 dB for a second order directional microphone. In this case, the microphone noise produced by the microphones remains approximately the same. The signal-to-noise ratio during directional microphone operation can thus be controlled with the aid of the internal, variable delay time. If this matching process is controlled adaptively as a function of the signal level of the acoustic input signal, then a high signal-to-noise ratio with AI–DI values of 4.5 to 5 dB, which are sufficient for these levels, can be achieved in a quiet environment. When the signal level of the acoustic input signal rises, a lower signal-to-noise ratio can be accepted, since the higher microphone noise associated with this is masked by the acoustic input signal. A variable AI–DI value is thus possible by adjusting the delay as a function of the situation, thus allowing better suppression of an interference signal from the side or from the rear when the acoustic input signal is loud.

The frequency response of a multiple microphone system according to the invention generally has a directionality operation behavior such that high frequencies are more strongly emphasized when the acoustic input signal level is low, while the gain for high frequencies is automatically reduced when the environment is loud, as in the case of AGC (automatic gain control). As an example, this applies to a conventional mixed form of first and second order directionalities. If required, an equalization filter can also be provided for a hearing aid according to the invention, which can be used to compensate for the AGC effect caused by the invention.

The matching of the internal delay time, or of the internal delay times, as a function of at least one microphone signal according to the invention may be carried out in discrete steps. However, the matching process is preferably carried out continuously with smooth transitions, so that the control process does not cause any switching artifacts.

In an embodiment of the invention setting of the delay of the microphone signal is not controlled directly by the signal level of the acoustic input signal, but by the signal level of the microphone output signal. For example, in an environmental situation in which there is no useful signal, or virtually no useful signal, from the direction in which the hearing aid wearer is looking, but the interference noise from the side or from the rear is relatively loud, then, in the case of a hearing aid according to the invention, exclusive consideration of the acoustic input signal picked up by an omnidirectional microphone would lead to relatively strong directionality being set, with increased microphone noise associated with this. Since, in the described situation, the interference signal is virtually masked out by the high directionality, the hearing aid wearer can be supplied with greater microphone noise, which is found to be disturbing. If the microphone signal that is actually emitted from the microphone system is taken into account, it would then be possible to reduce the directionality according to the invention to such an extent that the microphone noise is at least partially masked by the acoustic interference signal, which is then not suppressed to such an extent.

The invention offers the advantage that this adaptive control of the internal delay of a microphone signal allows the signal-to-noise ratio of the higher order multiple microphone system ($n^3$ 1) to be controlled as a function of the signal level of the acoustic input signal and, possibly, also as a function of the incidence direction of the acoustic input signal. Particularly when the input signal levels are quiet, this makes it possible to avoid a high level of microphone noise, which is found to be disturbing.

The invention can be used for all known hearing aid types with an adjustable directional microphone, for example for hearing aids which can be worn behind the ear, hearing aids which can be worn in the ear, implantable hearing aids or pocket hearing aids. Furthermore, the hearing aid according to the invention may also be part of a hearing aid system which comprises a number of appliances for supplying someone with hearing problems, for example part of a hearing aid system with two hearing aids which are worn on the head, for binaural supply, or part of a hearing aid system comprising one appliance which can be worn on the head, and a processor unit which can be worn on the body.

DESCRIPTION OF THE PREFERRED EMBODIMENTS

Figure 1:
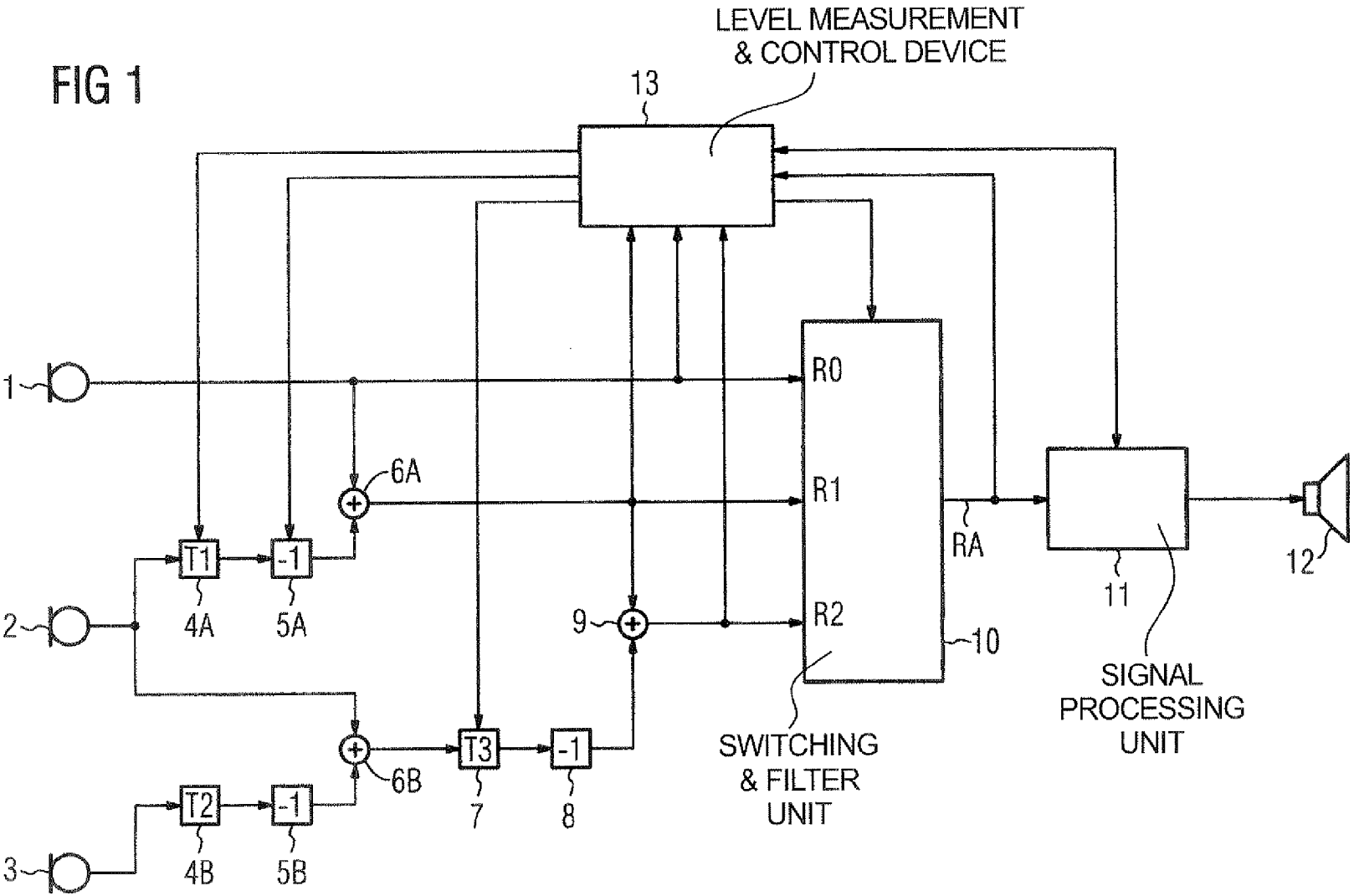
FIG. 1 is a block diagram of a hearing aid with three omnidirectional microphones in accordance with the invention.

FIG. 1 is a circuit diagram of the basic components of a hearing aid with a directional microphone system according to the invention. The microphone system comprises three omnidirectional microphones 1, 2 and 3. The microphone signal that originates from the microphone 2 is delayed in a delay unit 4A, is inverted by an inverter 5A, and is added in an adder 6A to the microphone signal R0 which originates from the microphone 1. Overall, the inversion and addition results in the microphone signal that originates from the microphone 2 being subtracted from the microphone signal that originates from the microphone 1. The two omnidirectional microphones 1 and 2 thus form a microphone unit 1, 2 with a first order directional characteristic, from which the microphone signal R1 originates. In the same way, the microphone signal which originates from the microphone 3 is delayed in a delay unit 4B, is inverted by an inverter 5B and is added in an adder 6B to the microphone signal which originates from the microphone 2. The microphones 2 and 3 also thus form a microphone unit 2, 3 with a first order directional characteristic, the microphone signal of which is produced at the output of the adder 6B. If the microphone signal which originates from the microphone unit 2, 3 is in turn delayed in a delay unit 7 and is inverted in an inverter 8 and is added in an adder 9 to the microphone signal R1 which originates from the microphone unit 1, 2, then this results in the microphones 1, 2 and 3 forming a microphone system 1, 2, 3 with a second order directional characteristic, whose microphone signal R2 is produced at the output of the adder 9.

The three microphone signals R0, R1 and R2 are supplied to a switching and filter unit 10, in which it is possible to switch between the different microphone signals R0, R1 and R2, or in which the microphone signals R0, R1 and R2 are differently weighted and added. The resultant microphone output signal RA which is emitted at the output of the switching and filter unit 10 is, finally, supplied to a signal processing unit 11, in which the further processing and frequency-dependent amplification of the microphone output signal RA are carried out in order to compensate for the individual hearing loss of a hearing aid wearer. Finally, the processed microphone signal is converted to an acoustic signal, for emission through an earpiece 12 into the auditory channel of the hearing aid wearer.

The hearing aid according to the exemplary embodiment also has a level measurement and control device 13, to which the microphone signal R0 from the omnidirectional microphone 1 is supplied. This microphone signal is used to detect the signal level of the acoustic input signal that is currently arriving at the microphone 1. The level measurement and control device 13 uses this signal level to produce parameters for adjustment of the delay in the delay units 4A, 4B and 7, thus making it possible to influence the directionality, and if necessary to reduce the microphone noise, according to the invention.

In order to assess whether and to what extent a hearing aid wearer perceives microphone noise in a specific environmental situation, current hearing aid settings are preferably also taken into account, in addition to audiometric data relating to the hearing aid wearer (rest hearing threshold, masking threshold). These settings also relate in particular to the microphone system. For example, in the environmental situation with a high interference sound component, the evaluation of the microphone signal R0 at the input of the microphone system results in the finding that the signal level of the acoustic input signal is high. However, it is possible in this environmental situation to largely suppress the interference signal by setting the microphone system to have high directionality, so that only a relatively quiet output signal is supplied to the hearing aid wearer. The microphone noise in this output signal can then possibly assume a clearly perceptible proportion of this output signal. For this reason, the delay time settings according to the invention preferably also take account of the microphone signals that originate from a directional microphone unit. In the exemplary embodiment, these are the microphone signals R1 and R2. Furthermore, it is also possible to evaluate the microphone output signal RA that is produced at the output of the switching and filter unit 10 and is supplied to the signal-processing unit 11 for further processing. Taking account of the hearing aid characteristics and settings, it is then possible to use this signal to directly determine what signal level is actually being supplied to the hearing aid wearer in response to the current acoustic input signal, and the proportion of this that is represented by the microphone noise.

The instantaneous environmental situation can be identified well by evaluation of both a microphone signal that is produced by an omnidirectional microphone and the microphone signals from microphone units with a directional characteristic. In particular, it is also possible to estimate whether the proportion of the microphone noise in the microphone signal which is provided for further processing in the signal processing unit 11 can be perceived by the hearing aid wearer with the hearing aid settings at that time. An excessively high proportion of microphone noise in the microphone output signal leads to the level measurement and control device 13 for at least one of the delay units 4A, 4B or 7 increasing the delay setting until the proportion of the microphone noise in the microphone output signal reaches a value which is considered to be acceptable.

Conversely, if the microphone output signal is at a high signal level, and the microphone noise makes up only a small proportion of this, then relatively short delay times may be set for all three delay units 4A, 4B and 7, thus increasing the directionality and suppressing the interference sound component in the acoustic input signal. In particular, the low frequencies also are reduced, and the high frequencies increased, during this transition. In order to avoid this effect, the level measurement and control device 13 also acts on the switching and filter unit 10, so that the last-mentioned effects are largely compensated for by suitable filter settings.

Thus, overall, the invention provides the capability to change the setting of the directional microphone system in a quiet hearing environment, so as to prevent clearly audible and disturbing microphone noise. On the other hand, however, the advantages of a higher order directional microphone system are fully exploited in a loud hearing environment.

Another advantageous feature of the hearing aid according to the exemplary embodiment is that there is an electrical connection between the level measurement and control device 13 and the signal-processing unit 11. The evaluation of the microphone signal or microphone signals in the level measurement and control device 13 can thus also be used for automatic situation identification, and thus for adaptive control of the signal processing in the signal processing unit 11. Furthermore, it may also be possible to manually set hearing programs for different hearing environments in the signal processing unit 11, with some of these hearing programs influencing the delay times according to the invention, while others do not. Provision is thus also made for signals to be transmitted from the signal-processing unit 11 to the level measurement and control unit 13.

The signal processing in the hearing aid according to the exemplary embodiment may be carried out using analog, digital or combined circuit technology. Furthermore, the signal processing may also be carried out in parallel, in adjacent frequency bands (channels). The directional characteristic of the microphone system preferably also is set in frequency bands.

Figure 2:
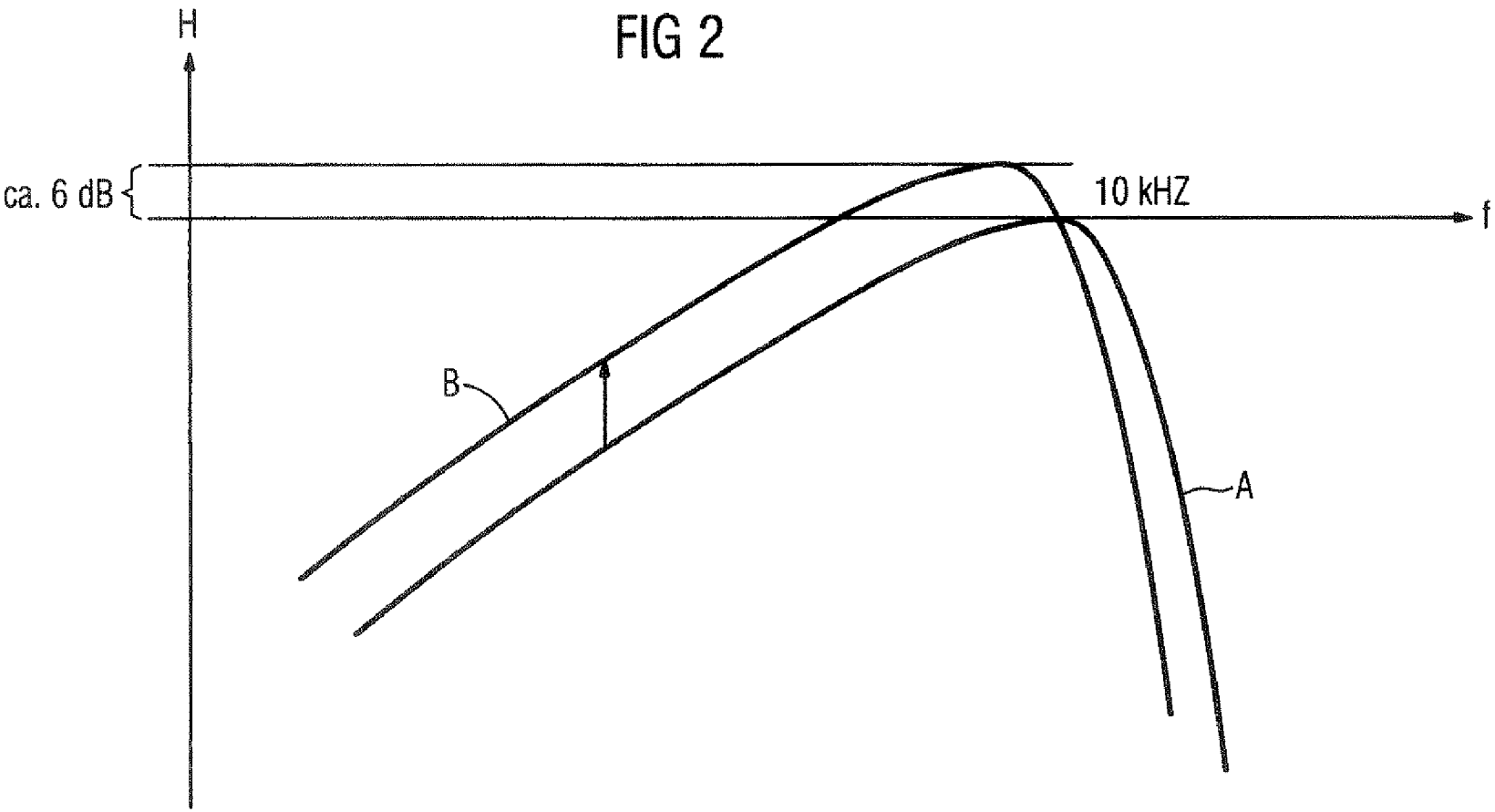
FIG. 2 shows the signal transmission response of a directional microphone system according to the invention, for two different delay times.

FIG. 2 shows the effects of adaptive directional microphone setting according to the invention, illustrated in the form of a graph. A first characteristic A shows the signal transmission response of a directional microphone system for one specific setting of the signal delay in the delay units in the directional microphone system. In this case, the internal delay is shorter than the external delay time of an acoustic signal that arrives at the microphone system from the front (viewing direction), with the microphones (and their sound inlet openings) being arranged one behind the other in the viewing direction. In a mixed form of first and second order microphone units, whose microphone signals are processed further jointly, it is thus possible to achieve a directionality value, weighted with the articulation index AI–DI of up to 6.5.

The frequency response of the microphone system is described by a function in the form:

$$H=1-e^{j\omega(D_{ext}+D_{int})}$$

In this case, the characteristic shows the typical high-pass behavior of a higher order directional microphone system. According to the invention, the transmission characteristic A is selected in particular in a loud hearing environment.

If the signal level of the acoustic input signal falls, or the proportion of the microphone noise in the microphone output signal which is produced by the microphone system is dominant, then the signal delay for at least one microphone signal in the directional microphone system is increased, which, in the event of the internal delay being doubled in comparison to the external delay time, results, for example, in a transition from the signal transmission response of the directional microphone system from the characteristic A to the second illustrated characteristic B. This is higher by about 6 dB than the characteristic A. In contrast, the microphone noise remains approximately constant. Although the internal signal delay initially results in the AI–DI value decreasing, it then becomes constant, however, at values of 4.5 5 dB, even if the internal delay is increased further, thus still resulting in relatively good directionality. Thus, overall, the signal-to-noise ratio in the directional microphone mode can be controlled with the aid of the internal delay times, which can be set electrically.

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing aid comprising:

a first omnidirectional microphone producing a first microphone signal;

a second omnidirectional microphone producing a second microphone signal;

said first and second omnidirectional microphones being electrically connected to each other to form a microphone unit, said microphone unit comprising a delay element to which one of said first and second microphone signals is supplied for delaying said one of said first and second microphone signals by a delay time with respect to the other of said first and second microphone signals for giving a microphone unit signal produced by said microphone unit a directional characteristic;

an adjustment unit connected to said delay unit for adjusting said delay time dependent on a signal level of an acoustic input signal to at least one of said first and second omnidirectional microphones;

a signal processor for processing said microphone unit output signal to produce a processed signal; and an output transducer for converting said processed signal into an audio signal and for emitting said audio signal.

2. A hearing aid comprising:

a first omnidirectional microphone producing a first microphone signal;

a second omnidirectional microphone producing a second microphone signal;

a third omnidirectional microphone producing a third microphone signal;

said first and second omnidirectional microphones being electrically connected to each other to form a microphone unit producing a microphone unit signal having a directional characteristic;

said microphone unit and said third omnidirectional microphone being electrically connected to each other to form a microphone system, said microphone system including a delay unit for delaying one of said microphone unit signal and said third microphone signal by a delay time relative to the other of said microphone unit signal and said third microphone signal for giving a microphone system signal produced by said microphone system a directional characteristic;

an adjustment unit connected to said delay unit for adjusting said delay time dependent on a signal level of an acoustic input signal to at least one of said first, second or third omnidirectional microphones;

a signal processor supplied with said microphone system signal for producing a processed signal therefrom; and an output transducer supplied with said processed signal for converting said processed signal into an output audio signal and for emitting said output audio signal.

3. A method for adjusting a directional characteristic of a microphone unit in a hearing aid, said microphone unit comprising two omnidirectional microphones each producing a microphone signal, comprising the steps of:

delaying the microphone signal from a first of said omnidirectional microphones by a delay time relative to the microphone signal from a second of said omnidirectional microphones, to produce a delayed microphone signal, and subtracting the delayed microphone signal from the microphone signal from the second of said omnidirectional microphones to give a microphone unit signal produced by said microphone unit a directional characteristic; and setting said delay time dependent on a signal level of an acoustic input signal to at least one of said omnidirectional microphones.

4. A method as claimed in claim 3 comprising setting said delay time dependent on a signal level of the microphone signal from one of said omnidirectional microphones.

5. A method as claimed in claim 3 comprising increasing said delay time as said signal level decreases.

6. A method as claimed in claim 3 comprising changing said delay time in steps as said signal level changes.

7. A method as claimed in claim 3 comprising changing said delay time continuously as said signal level changes.

8. A method as claimed in claim 3 wherein said microphone unit signal is subject to an increase in signal level as said delay time is increased, and comprising the additional step of automatically compensating for said increase in said signal level of said microphone unit signal.

9. A method for operating a hearing aid having a microphone system with a first omnidirectional microphone producing a first microphone signal, a second omnidirectional microphone producing a second microphone signal, and a third omnidirectional microphone producing a third microphone signal, comprising the steps of:

electrically connecting said first and second omnidirectional microphones to form a microphone unit producing a microphone unit signal having a directional characteristic;

electrically connecting said microphone unit with said third omnidirectional microphone to form said microphone system, and delaying one of said microphone unit signal and said third microphone signal by a delay time relative to the other of said microphone unit signal and said third microphone signal to produce a microphone system signal having a directional characteristic; and setting said delay time dependent on a signal level of an acoustic input signal to at least one of said microphone unit and said third omnidirectional microphone.

10. A method as claimed in claim 9 comprising setting said delay time dependent only on the signal level of said third microphone signal.

11. A method as claimed in claim 9 comprising setting said delay time dependent only on the signal level of said microphone unit signal.

12. A method as claimed in claim 9 comprising setting said delay time dependent on said microphone system signal.

13. A method as claimed in claim 9 comprising increasing said delay time as said signal level decreases.

14. A method as claimed in claim 9 comprising changing said delay time in steps as said signal level changes.

15. A method as claimed in claim 9 comprising changing said delay time continuously as said signal level changes.

16. A method as claimed in claim 9 comprising, in said microphone unit, delaying one of said first and second microphone signals relative to the other of said first and second microphone signals to give said microphone unit signal said directional characteristic and, when said signal level is low, setting said delay time, for giving said microphone system signal said directional characteristic, to be greater by a factor than said delay time for giving said microphone unit signal said directional characteristic.

17. A method as claimed in claim 16 comprising employing a factor in a range between 1.5 and 5.

18. A method as claimed in claim 9 wherein a signal of said microphone system output signal is subject to an increase as said delay time is increased, and comprising the step of compensating for said increase in said microphone system signal.

* * * * *